US005815467A

United States Patent [19]

Deering

[11] Patent Number: 5,815,467

[45] Date of Patent: Sep. 29, 1998

[54] SECURITY WATCH

[76] Inventor: Jay A. Deering, 7840 Big River Dr., Reno, Nev. 89506

[21] Appl. No.: 689,293

[22] Filed: Aug. 6, 1996

[51] Int. Cl.[6] ..... G04B 47/00; G04B 37/00; B67D 5/64; B67B 7/28

[52] U.S. Cl. ..... 368/10; 368/278; 222/78; 222/81; 222/175

[58] Field of Search ..... 368/10, 12, 276, 368/278; 222/39, 78, 80–83, 125, 394, 398

[56] References Cited

U.S. PATENT DOCUMENTS

| | | | |
|---|---|---|---|
| 4,068,313 | 1/1978 | Goldman . | |
| 4,341,443 | 7/1982 | Robinson . | |
| 4,446,990 | 5/1984 | Stevenson et al. | 222/80 |
| 4,581,773 | 4/1986 | Cunnane . | |
| 5,069,168 | 12/1991 | Roberson et al. . | |
| 5,259,338 | 11/1993 | Cornell . | |
| 5,358,144 | 10/1994 | Mock | 222/78 |
| 5,461,730 | 10/1995 | Carrington . | |
| 5,516,005 | 5/1996 | Moseley | 222/3 |
| 5,663,932 | 9/1997 | Weng | 368/10 |

*Primary Examiner*—Vit W. Miska
*Attorney, Agent, or Firm*—Chase & Yakimo

[57] ABSTRACT

A security device for attachment to a child by a support, such as a wristband, having a housing mounted thereon. The housing includes a first chamber and a second chamber sealed from one another until the device is armed. The first chamber stores an inert pressurized gas, such as carbon dioxide, and the second chamber stores a harmless, sprayable powder. An arming member is mounted substantially adjacent the first chamber for unsealing the first chamber to allow the gas to travel through the passageway into the second chamber. An activation member is attached to the housing for spraying the mixed powder and gas therefrom. Preferably, the device includes a clock having an exterior time display mounted to the housing.

23 Claims, 6 Drawing Sheets

SECURITY WATCH

FIELD OF THE INVENTION

This invention relates to a child safety device which helps protect a child from danger, especially abduction or attack. More specifically, the device sprays a cloud of brightly colored, harmless powder to alert others of the child's danger.

BACKGROUND OF THE INVENTION

Various types of safety devices for adults are known, such as mace sprayers and electro-shock devices. These are inappropriate for use by children. The devices are harmful and children may inadvertently set them off during play, potentially harming themselves and innocent bystanders. Furthermore, known safety devices are difficult for children to carry and/or access and may be easily lost.

SUMMARY OF THE INVENTION

Accordingly, a primary object of the subject invention is to provide a security device for children having a housing which isolates an inert gas from a harmless powder or other substance until activation thereof to spray the powder from within the housing.

Another object of the subject invention is to provide a security device which sprays a brightly colored harmless substance therefrom to alert others of the wearer's impending danger.

Yet another object of the subject invention is to provide a security device that is easily accessible and activated.

Still a further object of the subject invention is to provide a security device that is worn on the wrist of the potential victim.

Still a further object of the subject invention is to provide a security device that appears to be a watch from a distance and in fact co-acts as a watch.

These objects are attained by providing a wristband for attaching the device to the child, a housing on the wristband having a first chamber and a second chamber sealed from one another and having a passageway extending between the chambers. The first chamber stores an inert gas and the second chamber stores a sprayable powder or other harmless substance. An arming member is mounted substantially adjacent the first chamber for unsealing the chamber to allow the gas to travel through the passageway into the second chamber. Gas inlet ports between the passageway and the second chamber allow the released gas to pressurize the second chamber and mix with the powder stored therein. An activation member is attached to the housing for unsealing the second chamber to allow the powder to discharge therefrom upon mixing with the gas. The device further includes a clock mounted to the housing.

Other objects and advantages of this invention will become apparent from the following description taken in connection with the accompanying drawings, wherein is set forth by way of illustration and example, an embodiment of this invention.

DETAILED DESCRIPTION

Figure 1:
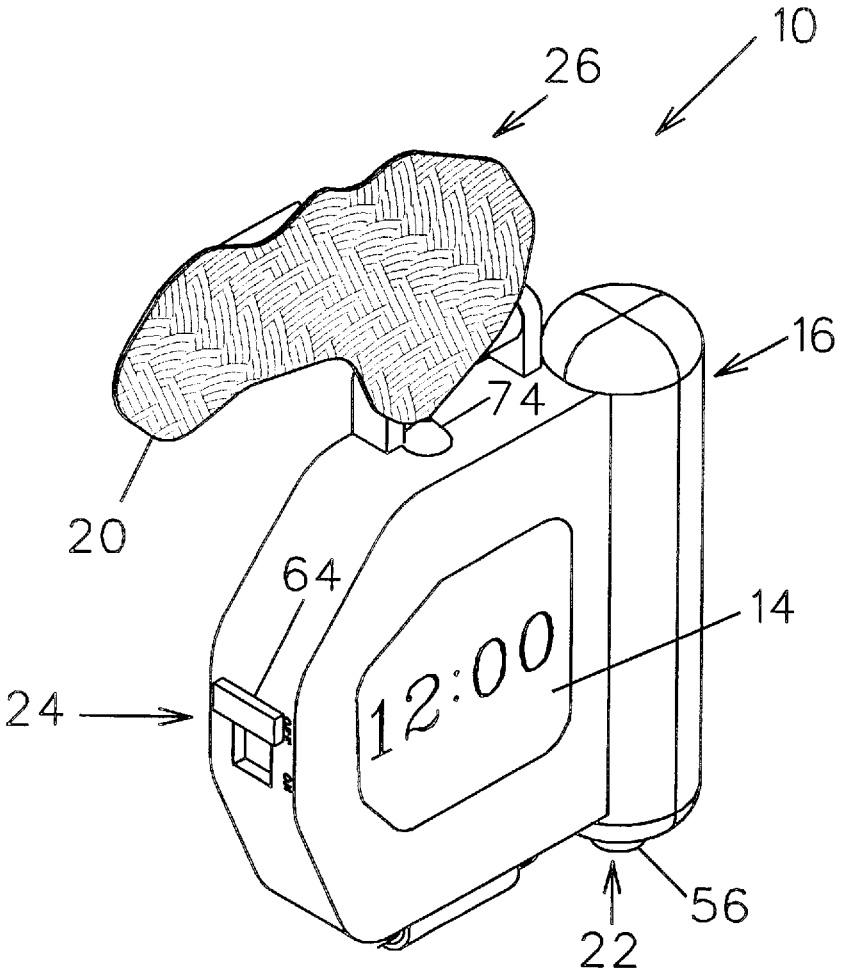
FIG. 1 is a side perspective view of a security device in accordance with the present invention showing the danger alerting powder being released therefrom and with the wristband removed for clarity.
Figure 2:
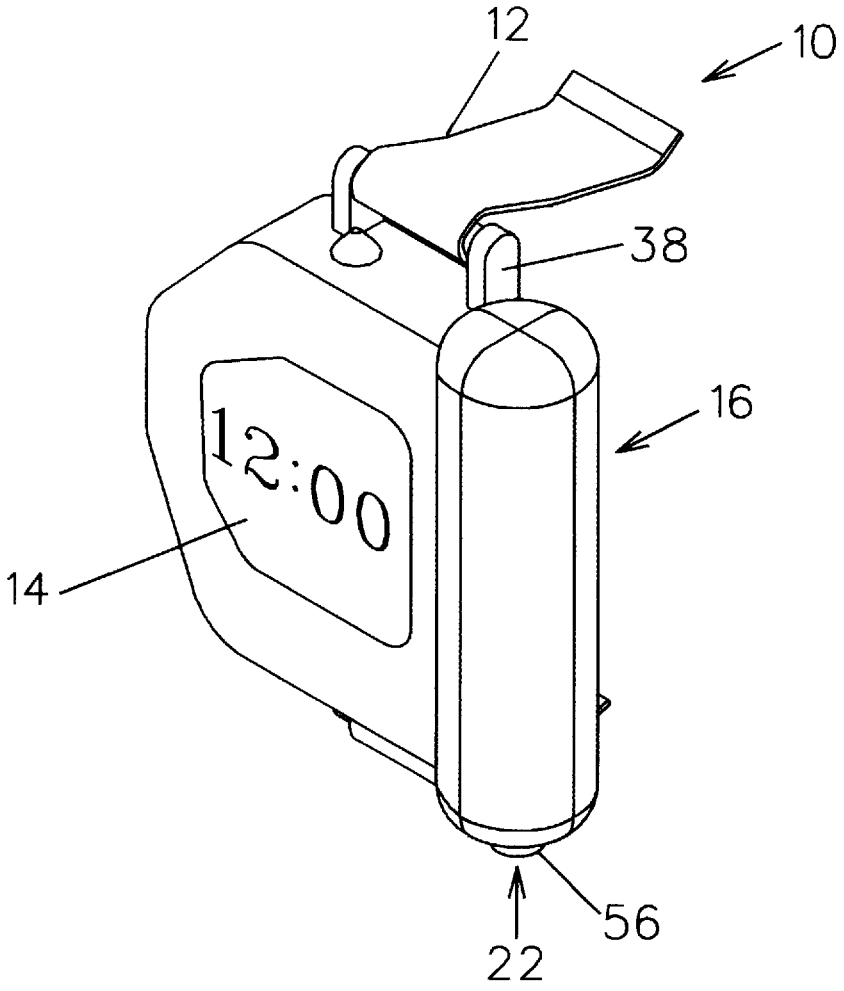
FIG. 2 is a perspective view of the security device of FIG. 1 pivoted 90° and with the powder removed to show the wristband.
Figure 3:
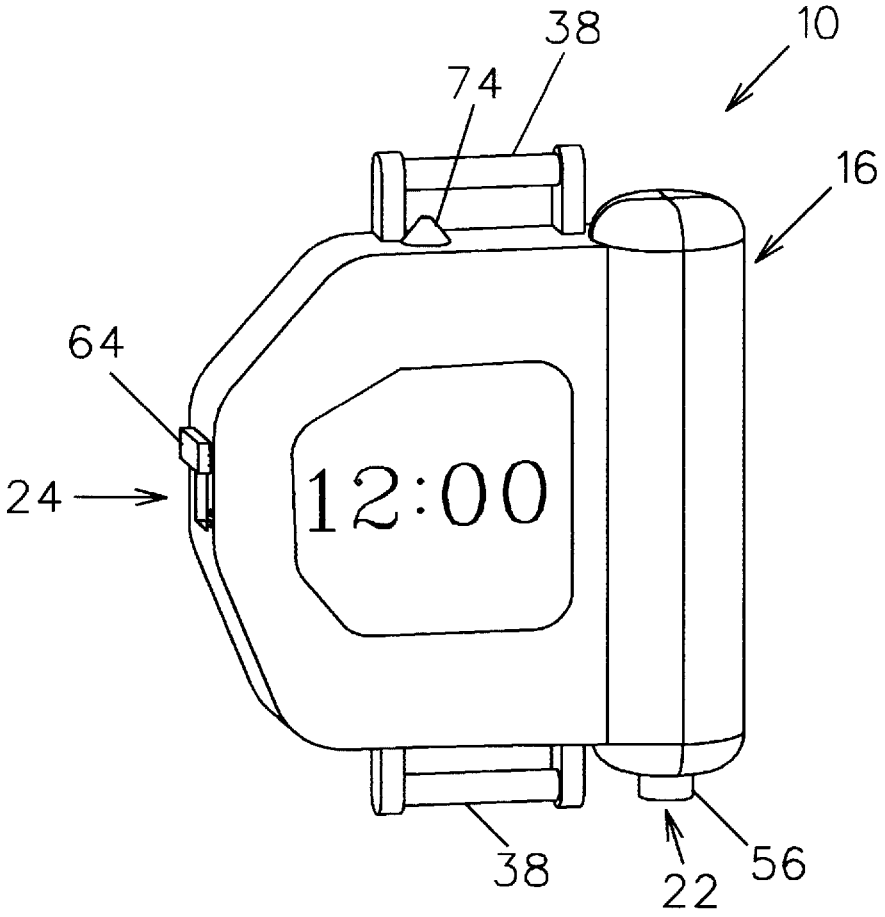
FIG. 3 is a front perspective view of the security device of FIG. 1.

Child security device 10, as shown in FIGS. 1–3, protects children from abduction and other dangers. Device 10, in the form of a watch, is secured to a child by wristband or support 12 extending between mounting brackets 38. Device 10 preferably includes a clock 14 mounted in device 10 having an exterior time display. Device 10 should be shock-resistant and waterproof to prevent damage during the child's play, etc.

Device 10 includes housing 16 attached to wristband 12. Housing 16 initially includes a pressurized, expandable gas 18 separated from a harmless sprayable substance 20 until the gas 18 is unsealed by arming member 22 causing the gas 18 and sprayable substance 20 to mix. Once armed, device 10 is capable of spraying a sizeable cloud 26 of substance 20 via activation member 24 from within housing 16, as in FIG. 1.

Preferably, gas 18 is carbon dioxide and sprayable substance 20 is a brightly colored, harmless powder, such as talcum powder or other silicate. Powder 20 sprays from a chamber 34 of housing 16 to form a brightly colored cloud 26 around the endangered child, warning others of the danger and frightening and obscuring the vision of the potential attacker. Gas 18 and powder 20 should be harmless to prevent maiming the user, attacker and innocent bystanders, such as other children, in case of accidental activation by the child.

Figure 4:
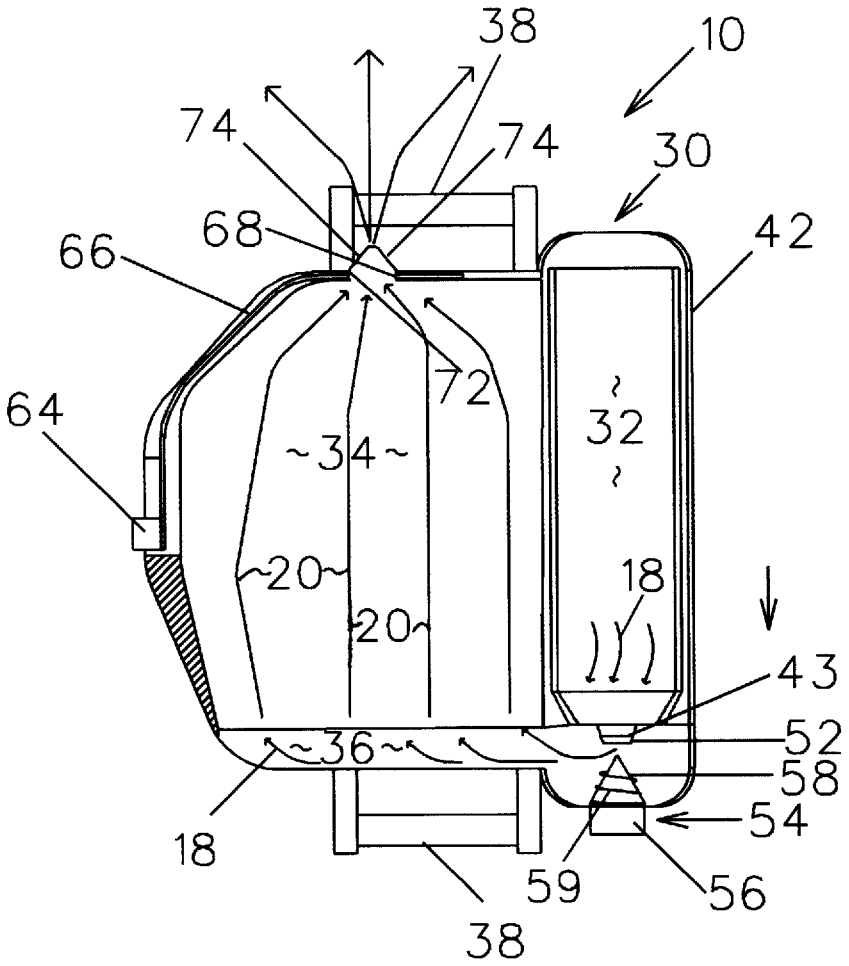
FIG. 4 is a perspective view of the device with the housing removed therefrom for clarity.

Housing 16 is sealed except upon activation of device 10 and includes outer casing 30, first chamber 32, second chamber 34 and passageway 36 as seen in FIG. 4. Outer casing 30 surrounds or envelopes first and second chambers 32 and 34 and passageway 36.

First chamber 32 is a cartridge for containing a pressurized gas 18, and second chamber 34 houses powder 20. The first chamber 32 is initially sealed to isolate gas 18 from powder 20. Passageway 36 extends between chambers 32 and 34. First chamber 32 is preferably protected by a mar resistant cover 42 and includes a frusto-conical port 43 extending from chamber 32 into passageway 36. First chamber 32 may be molded to outer casing 30 and one side of second chamber 34.

Figure 6:
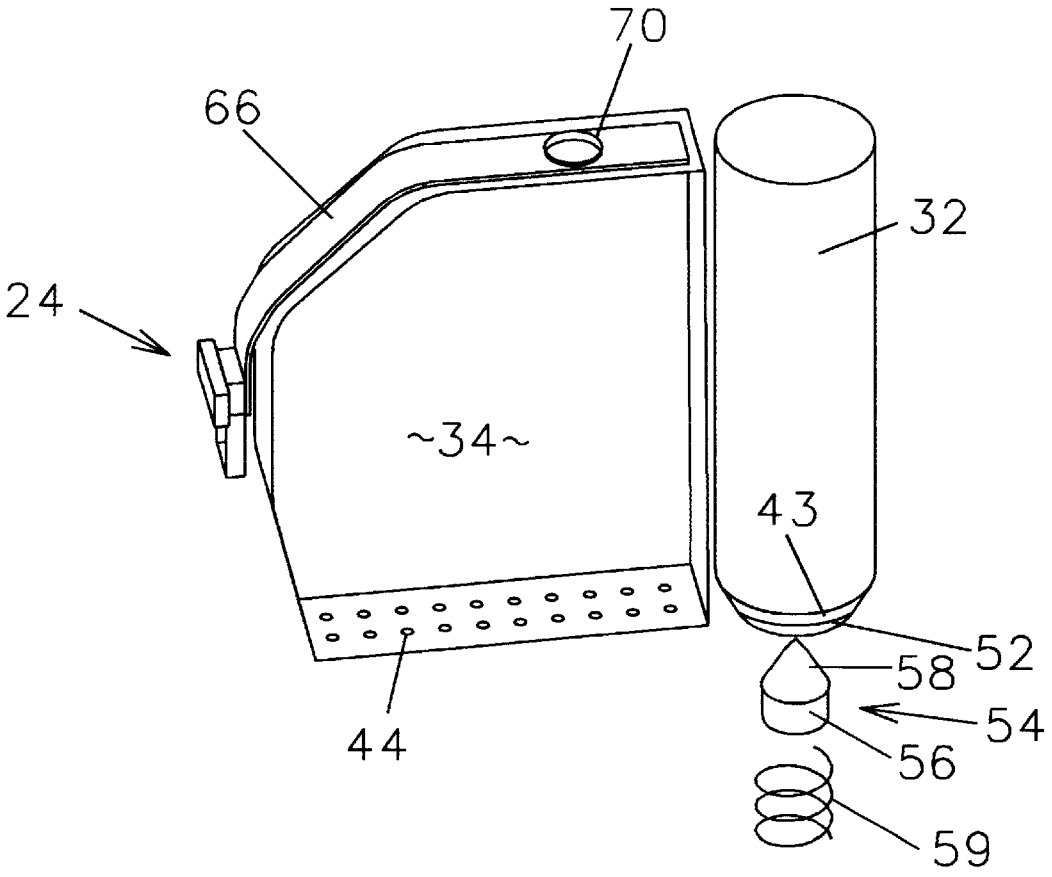
FIG. 6 is an enlarged front cross-sectional view showing the exhaust port closed.

Arming assembly 22 includes gas inlet ports 44, releasable seal 52 on port 43 and arming button 54, as seen in FIGS. 4 and 6. The seal 52 may be a soft metal lid extending about the open end of port 43. Gas inlet ports 44 are formed through one wall of second chamber 34 adjacent passageway 36, as seen in FIG. 6. The diameter of ports 44, preclude powder 20 stored within second chamber 34 to fall into passageway 36.

Arming button 54 is mounted to and extends through casing 30 in alignment with seal 52. Arming button 54 may be spring loaded 59. Arming button 54 partially extends exterior of casing 30 to present a push-button 56, which is easily accessible by the wearer. Arming button 54 further includes a pointed cone 58, which upon depression of push-button 56 punctures the soft metal lid 52 and thereby releases the pressurized gas 18 from first chamber 32 for travel through passageway 36 and into second chamber 34 via inlet ports 44. Depressing arming button 54 as described, places device 10 in an armed condition, ready for activation if the wearer is placed in danger.

Figure 5:
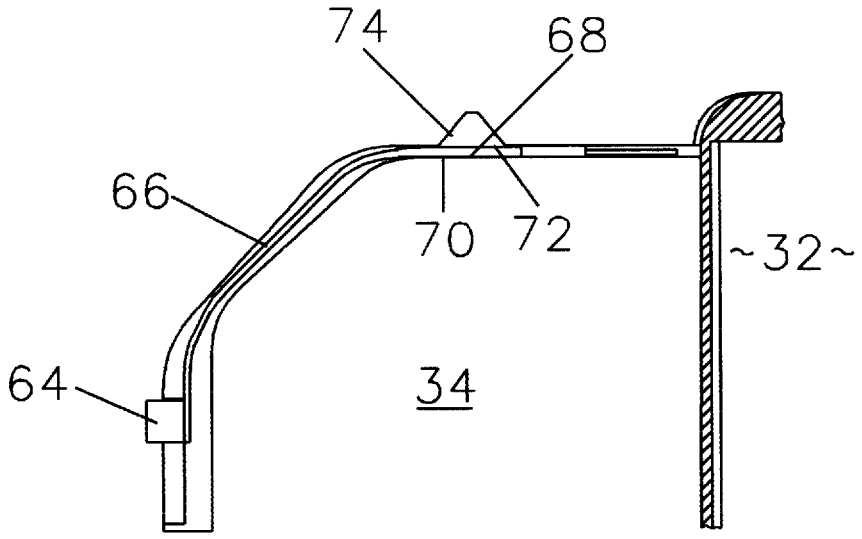
FIG. 5 is a front cross-sectional view of the device showing the exhaust port open.

Activation member 24 includes switch 64, release band 66 and powder release ports 68, 70 and 72, as seen in FIGS. 4–6. Switch 64 is mounted on the exterior of casing 30 adjacent second chamber 34 and is vertically slidable between an on position, as in FIG. 4, and an off position, as in FIGS. 5 and 6.

Powder release band 66 is attached at one end to switch 64 and mounted within the interior of casing 30, over the exterior surface of second chamber 34. Powder release band 66 slides over the exterior surface of second chamber 34 as switch 64 is moved between its on and off positions.

Powder release port 68 extends through the wall of second chamber 68 and is aligned with release port 72 which extends through casing 30. A band 66 release port 70 is aligned with ports 68 and 72 when switch 64 is moved to its on position, allowing gas 18 and powder 20 to spray from second chamber 34. A pointed cone port 74 preferably extends around the circumference of casing release port 72 to enhance the spraying of powder 20. A plurality of casing release ports 72 may be formed through casing 30, if desired.

Device 10 may be either a one-time spraying device or replaceable gas cartridges 32 may be sold therewith for multiple uses of device 10.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A security device, comprising:

a securing means for attaching said device to a user;

a housing on said securing means having a sealed first chamber for storing a pressurized gas and a second chamber for storing a sprayable substance and a passageway extending between said chambers;

arming means adjacent said first chamber for unsealing said first chamber to allow said pressurized gas to travel from said first chamber through said passageway and into said second chamber for commingling with said sprayable substance; and user-operable discharge means attached to said housing for discharging said substance and gas from a port in said second chamber, including a user operable closure element movable between open and closed positions over said port.

2. A device as claimed in claim 1, wherein said securing means includes a wristband attached to said housing.

3. A device as claimed in claim 1, wherein said gas is carbon dioxide.

4. A device as claimed in claim 1, wherein said sprayable substance is powder.

5. A device as claimed in claim 4, wherein said powder is brightly colored.

6. A device as claimed in claim 1, wherein said arming means includes a sealed aperture in said first chamber and in communication with said passageway, gas inlet ports between said passageway and said second chamber and user operable puncture means on said housing for piercing said sealed aperture.

7. A device as claimed in claim 6, wherein said puncture means comprises a spring-loaded push-button having one end for piercing said sealed aperture.

8. A device as claimed in claim 1 further comprising a clock in said housing.

9. A security device, comprising:

a wristband for attaching said device to a user;

a housing on said wristband having a first chamber for storing a pressurized gas, a second chamber for storing powder and in communication with said first chamber, said first chamber being initially sealed;

arming means substantially adjacent said first chamber for unsealing said first chamber, to allow said gas in said first chamber to travel into said second chamber, said arming means including a sealed aperture extending through said first chamber in communication with said second chamber; a spring-loaded push-button on said housing having an end for piercing said aperture and gas inlet ports formed between said passageway and said second chamber; and activation means attached to said housing to discharge said gas and powder from said second chamber, said activation means including exhaust means in said housing regulated by a user-operable closure means.

10. A device as claimed in claim 9, wherein said closure means comprises:

a switch extending from said housing and movable between on and off positions;

a band extending from said switch;

a port in said band; and said exhaust means comprises:

a port in said housing;

a port in said second chamber and aligned with said housing port;

whereupon user movement of said switch to an on position aligns said band port with said aligned housing and second chamber ports to allow discharge of said powder from said chamber.

11. A device as claimed in claim 9 further comprising a passageway between said first and said second chambers to provide said communication.

12. A device as claimed in claim 9, wherein said device further comprises a time display to present a watch like appearance.

13. A device as claimed in claim 9, wherein said gas is carbon dioxide.

14. A device as claimed in claim 9, wherein said powder is brightly colored.

15. A device as claimed in claim 9, further comprising a clock in said housing.

16. A security device, comprising:

a support;

a housing on said support for sealing a gas from a sprayable substance, said gas and said substance being stored within said housing;

a user-operable arming means on said housing for unsealing said gas for commingling with said substance;

exhaust means on said housing to allow said commingled gas and substance to spray therefrom ; and a user operable closure member at said exhaust means for opening and closing said exhaust means.

17. A device as claimed in claim 16, wherein said support includes a wristband.

18. A device as claimed in claim 16, wherein said housing includes a clock having an exterior time display.

19. A device as claimed in claim 16, wherein said gas is carbon dioxide.

20. A device as claimed in claim 16, wherein said sprayable substance is powder.

21. A device as claimed in claim 20, wherein said powder is brightly covered.

22. A device as claimed in claim 16, wherein said housing includes a sealed first chamber for storing said gas and a second chamber for storing said sprayable substance and a passageway extending between said chambers; and said arming means includes a sealed aperture in said first chamber and in communication with said passageway, gas inlet ports between said passageway and said second chamber and user operable puncture means on said housing for piercing said sealed aperture.

23. A device as claimed in claim 22, wherein said puncture means comprises a spring-loaded push-button having one end for piercing said sealed aperture.

* * * * *